US009188908B2

(12) United States Patent
Hirayama et al.

(10) Patent No.: US 9,188,908 B2
(45) Date of Patent: Nov. 17, 2015

(54) WET-TYPE IMAGE FORMING APPARATUS WITH ADJUSTING DEVICE TO ADJUST AMOUNT OF CARRIER LIQUID CONTAINED IN TONER IMAGE

(75) Inventors: Junya Hirayama, Takarazuka (JP); Shigeo Uetake, Takatsuki (JP); Yuji Kamoda, Ibaraki (JP); Toshiya Natsuhara, Takarazuka (JP)

(73) Assignee: KONICA MINOLTA, INC. (JP)

( * ) Notice: Subject to any disclaimer, the term of this patent is extended or adjusted under 35 U.S.C. 154(b) by 644 days.

(21) Appl. No.: 13/416,042

(22) Filed: Mar. 9, 2012

(65) Prior Publication Data

US 2012/0237264 A1 Sep. 20, 2012

(30) Foreign Application Priority Data

Mar. 16, 2011 (JP) ..... 2011-057900

(51) Int. Cl.
*G03G 15/10* (2006.01)
*G03G 15/20* (2006.01)
*G03G 15/00* (2006.01)

(52) U.S. Cl.
CPC ..... *G03G 15/10* (2013.01); *G03G 15/2039* (2013.01); *G03G 15/5062* (2013.01)

(58) Field of Classification Search
CPC ..... G03G 15/11; G03G 15/10
USPC ..... 399/49, 67, 250, 251
See application file for complete search history.

(56) References Cited

U.S. PATENT DOCUMENTS 4,897,691 A * 1/1990 Dyer et al.
5,374,983 A 12/1994 Isogai
5,784,679 A * 7/1998 Schlueter et al.
6,347,212 B1 * 2/2002 Kosugi et al.
6,473,583 B2 * 10/2002 Watanabe
6,522,853 B2 * 2/2003 Iida et al.
6,608,982 B2 * 8/2003 Shin et al.
6,996,362 B2 * 2/2006 Kellie et al.
2002/0031372 A1 * 3/2002 Iida et al.
2002/0159801 A1 * 10/2002 Nakashima et al.

(Continued)

FOREIGN PATENT DOCUMENTS

JP 5-204273 A 8/1993
JP 6-40605 A 2/1994

(Continued)

OTHER PUBLICATIONS

Notice of Grounds of Rejection for Japanese Patent Application No. 2011-057900, mailed Apr. 8, 2014, with English translation.

*Primary Examiner* — Walter L Lindsay, Jr.
*Assistant Examiner* — Milton Gonzalez
(74) *Attorney, Agent, or Firm* — Cantor Colburn LLP

(57) ABSTRACT

An infiltration amount measuring unit is provided to measure the amount of carrier liquid infiltrated in recording paper. An output signal of the infiltration amount measuring unit is input to a control device to be used to calculate a voltage supplied to a heat source (heater) in a pre-fixing unit. A signal of a paper temperature measuring unit is input to the control device, which determines whether a target temperature is reached. The control device estimates the amount of carrier liquid in a toner layer based on the information from the infiltration amount measuring unit. Then, the pre-fixing unit is controlled such that the amount of carrier liquid in the toner layer falls within an appropriate range, based on the estimation result of the amount of carrier liquid.

13 Claims, 7 Drawing Sheets

(56) References Cited

U.S. PATENT DOCUMENTS

| | | | |
|---|---|---|---|
| 2003/0186157 | A1* | 10/2003 | Teraoka et al. |
| 2004/0057764 | A1* | 3/2004 | Jang |
| 2005/0212882 | A1* | 9/2005 | Naniwa |
| 2006/0210295 | A1* | 9/2006 | Nakaya et al. |

FOREIGN PATENT DOCUMENTS

| | | | | |
|---|---|---|---|---|
| JP | 07239647 | A | * | 9/1995 |
| JP | 9-244517 | A | | 9/1997 |
| JP | 10198215 | A | * | 7/1998 |
| JP | 2010-127966 | A | | 6/2010 |

* cited by examiner

WET-TYPE IMAGE FORMING APPARATUS WITH ADJUSTING DEVICE TO ADJUST AMOUNT OF CARRIER LIQUID CONTAINED IN TONER IMAGE

This application is based on Japanese Patent Application No. 2011-057900 filed with the Japan Patent Office on Mar. 16, 2011, the entire content of which is hereby incorporated by reference.

BACKGROUND OF THE INVENTION

1. Field of the Invention

The present invention relates to an electrophotographic image forming apparatus such as a copier, a printer, and a facsimile, and particularly to a wet-type image forming apparatus using a liquid developer to form a toner image.

2. Description of the Related Art

In an electrophotographic image forming apparatus, toner supplied from a developing device is used to develop an electrostatic image on a photoconductor. Then, the developed toner image is transferred onto recording paper, whereby an image is formed on the recording paper. In the transfer process in such an image forming apparatus, an electrostatic transfer technique is generally adopted.

When a toner image is transferred onto recording paper serving as a transfer target, voltage is applied by a transfer roller from the back side of the recording paper conveyed to a position opposing the photoconductor to form an electric field between the photoconductor and the recording paper. The electric field causes the toner image to be electrostatically adsorbed on the recording paper.

Thereafter, the toner image formed on the recording paper is heated and pressed by a fixing device, whereby the transferred toner image is fixed on the recording paper.

On the other hand, in recent years, in an image forming apparatus such as an office printer for bulk printing and an on-demand printer that requires higher image quality and higher resolution, a wet-type developing device is known, which uses a liquid developer with a small toner particle size that is less likely to produce toner image noise. The liquid developer is prepared by dispersing toner in a carrier liquid such as a paraffin-based solvent. In the development and transfer process, toner is moved by the effect of an electric field in a toner layer containing the carrier liquid and the toner, whereby an image is transferred onto recording paper.

In this way, the carrier liquid plays an important role in motion of toner but makes the fusibility of toner lower than when using toner alone. Therefore, it is necessary to set the fixing temperature higher.

However, when the fixing temperature is set high, if the amount of carrier liquid in the toner layer is small, the toner in contact with the fixing roller easily attaches to the surface of the roller. This phenomenon is called offset. Conversely, if the amount of carrier liquid in the toner layer is too large, the toner is not sufficiently fused, resulting in poor fixing. Therefore, in order to achieve both prevention of offset and good fixing performance, it is important to adjust the amount of carrier liquid in the toner layer within an appropriate range.

In this respect, Japanese Laid-Open Patent Publication No. 09-244517 discloses a technique for maintaining fixing performance by providing a pre-fixing unit before main fixing and adjusting the set temperature, etc. in the pre-fixing unit according to a paper type.

The technique disclosed in the publication above only adjusts the set temperature, etc. according to a paper type. However, the amount of carrier liquid in the toner layer greatly varies until fixing is completed, because the carrier liquid is infiltrated from the toner layer into the recording paper after transfer onto the recording paper. Therefore, it is difficult to control the amount of carrier liquid within an appropriate range unless the amount of carrier liquid in the toner layer is grasped before fixing. It is hard to accurately control the amount of carrier liquid in the toner layer only by adjusting the set temperature, etc. according to a paper type.

SUMMARY OF THE INVENTION

The present invention is made to solve the aforementioned problem. An object of the present invention is to provide a wet-type image forming apparatus capable of achieving both prevention of offset and good fixing performance by adjusting the amount of carrier liquid in a toner layer within an appropriate range.

A wet-type image forming apparatus according to an aspect of the present invention forms an image using a liquid developer containing carrier liquid and toner dispersed therein. The wet-type image forming apparatus includes: a fixing device configured to fix a toner image formed by development using the liquid developer onto an image recording medium; a first measuring device configured to carry out measurement for obtaining information corresponding to an amount of the carrier liquid infiltrated into the image recording medium before the image recording medium passes through the fixing device; and an adjusting device configured to adjust an amount of the carrier liquid contained in the toner image on the image recording medium based on a result of the measurement carried out by the first measuring device.

The wet-type image forming apparatus according to an aspect of the present invention includes the measuring device for measuring the amount of the carrier liquid infiltrated into the image recording medium before the image recording medium passes through the fixing device and the adjusting device for adjusting the amount of the carrier liquid in the toner image on the image recording medium, whereby the amount of carrier liquid in the toner image is adjusted within the appropriate range, thereby achieving both prevention of offset and good fixing performance.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
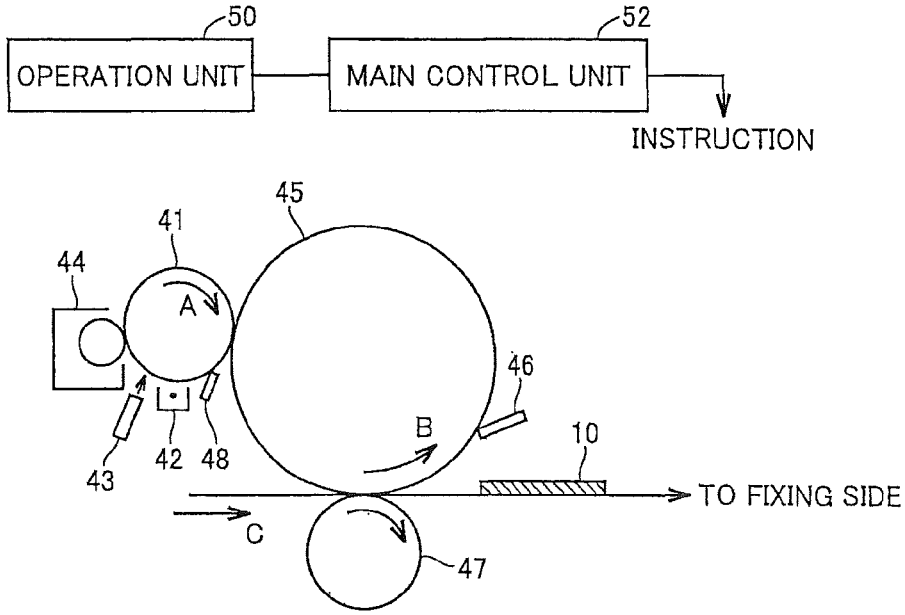
FIG. 1 is a schematic diagram illustrating a configuration of a wet-type image forming apparatus in accordance with an embodiment of the present invention.

In the following, embodiments of the present invention will be described with reference to the figures. In the following description, the same parts and components are denoted with the same reference numerals. Their names and functions are also the same.

FIG. 1 is a schematic diagram illustrating a configuration of a wet-type image forming apparatus in accordance with an embodiment of the present invention.

Referring to FIG. 1, a wet-type image forming apparatus includes an operation unit 50 for accepting operation from a user, a main control unit 52 for controlling the wet-type image forming apparatus as a whole according to an instruction from operation unit 50, and an image forming unit for forming an image according to an instruction from main control unit 52.

The image forming unit includes a developing device 44, a photoconductor 41, an intermediate transfer unit 45, a transfer roller 47, an exposure device 43, a charging device 42, and cleaning devices 46, 48. Recording paper 10 having an image formed thereon is conveyed to a fixing device.

Photoconductor 41 and intermediate transfer unit 45 function as image carriers.

In the surroundings of photoconductor 41, provided are charging device 42 charging the surface of photoconductor 41 evenly and exposure device 43 applying LED light or a laser beam onto the charged photoconductor 41 to form a static latent image. Developing device 44 then develops the static latent image using a liquid developer, and intermediate transfer unit 45 then transfers the developed toner image onto recording paper 10.

The toner image transferred onto intermediate transfer unit 45 is moved to a transfer position between intermediate transfer unit 45 and transfer roller 47 and transferred onto recording paper 10. Specifically, charging is performed or voltage is applied to recording paper 10, which is conveyed at the same speed as the peripheral speed of intermediate transfer unit 45. The developed toner image on intermediate transfer unit 45 is thus transferred onto recording paper 10. In this embodiment, the toner image once transferred onto intermediate transfer unit 45 is transferred onto recording paper. However, the toner image may be directly transferred from photoconductor 41 onto recording paper 10. The toner image left on photoconductor 41 is removed by cleaning device 48. The toner image left on intermediate transfer unit 45 is removed by cleaning device 46.

In FIG. 1, a single developing device 44 is arranged. However, a plurality of developing devices 44 may be arranged to form a color image. The color developing method and the presence/absence of intermediate transfer can be set as desired, and any configuration arrangement can be employed correspondingly.

Recording paper 10 having a toner image transferred thereon by transfer roller 47 is conveyed to the fixing device downstream in the conveyance direction and is discharged after heating and fixing. The configuration of fixing will be described later.

The liquid developer for use in development will now be described. In the liquid developer, colored toner particles are dispersed at a high concentration in a carrier liquid serving as a solvent. The liquid developer may include an additive such as a dispersant and a charge controller selected as appropriate.

The main components of the liquid developer are insulative liquid serving as a carrier liquid, toner for developing a static latent image, and a dispersant for dispersing toner.

Any carrier liquid that is generally used for a liquid developer for electrophotography can be used. Examples of the carrier liquid include isoparaffin-based ISOPAR (G, H, L, M, and so on) (Exxon Mobil Corporation), IP Solvent (1620, 2028, 2835, and so on) (Idemitsu Kosan Co., Ltd.), and paraffin-based MORESCO-WHITE (P-40, P-70, P-120) (MATSUMURA OIL Co., Ltd.). Silicon oil and mineral oil may be used.

The toner particles are mainly formed of resin and pigment or dye for coloring. The resin has a function of dispersing the pigment or dye evenly in the resin and a function as a binder during fixing on recording paper.

Any toner particle that is generally used in a liquid developer for electrophotography can be used. Examples of the resin for toner may include thermoplastic resins such as polystyrene resins, styrene acrylic resins, acrylic resins, polyester resins, epoxy resins, polyimide resins, polyimide resins, and polyurethane resins. More than one kind of these resins may be mixed for use.

Commercially available pigment and dye may be used to color the toner. Examples of the pigment may include carbon black, iron red, titanium oxide, silica, phtalocyanine blue, phtalocyanine green, sky blue, benzidine yellow, and lake red D. Examples of the dye may include Solvent Red 27 and Acid Blue 9.

The liquid developer can be prepared based on the generally used technique. For example, resin and pigment blended at a prescribed ratio are molten and kneaded to be dispersed evenly using a pressure kneader, a roller mill, or the like. The resultant dispersive product is finely ground, for example, by a jet mill. The resultant fine particles are classified, for example, by a wind classifier to obtain colored toner with a desired particle size. Then, the resultant toner particles and insulative liquid serving as a carrier liquid are mixed at a prescribed ratio. The mixture is evenly dispersed by dispersing means such as a ball mill, resulting in a liquid developer.

The mean particle size of toner may be 0.1 μm to 5 μm as the wet-type image forming technique is adopted. The particle size less than 0.1 μm considerably reduces developing performance, whereas the particle size greater than 5 μm reduces image quality. Therefore, it is desired to set the size to 0.1 to 5 μm.

The appropriate proportion of toner particles to the entire mass of the liquid developer (TC ratio) is 10 to 50%.

If less than 10%, sedimentation of toner particles is likely to occur, which is a problem in terms of stability over time during long-term storage. In addition, a large amount of liquid developer has to be supplied to achieve the required image density. This increases the amount of carrier liquid adhered to recording paper and thus requires treatment of vapor produced in drying during fixing. On the other hand, if exceeding 50%, the viscosity of liquid developer is too high, which may make it difficult to handle during production.

The viscosity of the liquid developer is desirably 0.1 mPa·s or more and 10000 mPa·s or less at 25° C. If greater than 10000 mPa·s, the handling such as stirring and feeding of the liquid developer becomes difficult, and the load on a device supplying the liquid developer evenly may be increased. If smaller than 0.1 mPa·s, the control of the amount of toner on the development roller becomes difficult, which makes it difficult to realize an appropriate image density.

Figure 2:
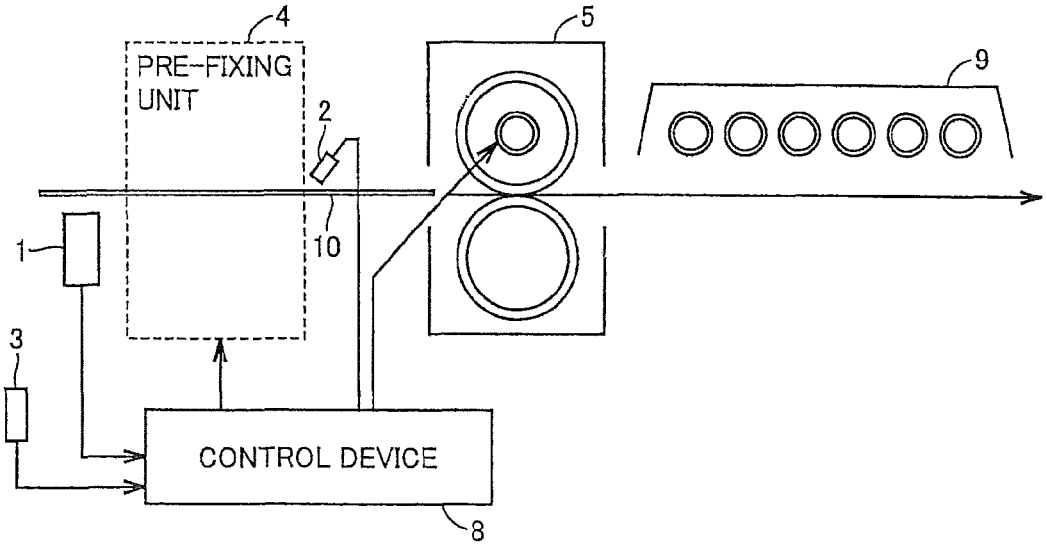
FIG. 2 illustrates a configuration of a fixing device in accordance with the embodiment of the present invention.

FIG. 2 illustrates a configuration of the fixing device in accordance with the embodiment of the present invention.

Referring to FIG. 2, the fixing device includes a pre-fixing unit 4, a main fixing unit 5, a drier 9, an infiltration amount measuring unit 1, an apparatus temperature measuring unit 3, a paper temperature measuring unit 2, and a control device 8 for controlling the fixing device as a whole. In the following, upstream and downstream refer to upstream and downstream in the direction in which recording paper 10 is conveyed.

Here, pre-fixing unit 4 is provided upstream of main fixing unit 5 to pre-fix the toner on recording paper 10 prior to main fixing unit 5.

In the vicinity of an upstream-side entrance of pre-fixing unit 4, infiltration amount measuring unit 1 is provided to measure the amount of infiltration of carrier liquid into recording paper 10. An output signal of infiltration amount measuring unit 1 is input to control device 8 to be used to calculate a voltage to be supplied to a heat source (heater) of pre-fixing unit 4.

In the vicinity of an exit of pre-fixing unit 4, paper temperature measuring unit 2 is provided to measure the temperature of recording paper 10. This is important sensing to grasp thermal energy applied to recording paper 10. Paper temperature measuring unit 2 is provided at a position that allows measurement of the temperature of recording paper 10 immediately after recording paper 10 passes through pre-fixing unit 4. A noncontact-type sensor is desirable so as not to affect the temperature of the measured object, because the heat capacity of recording paper 10 is small. A noncontact-type temperature sensor using a thermopile element is used, by way of example.

The signal of paper temperature measuring unit 2 is input to control device 8, which determines whether a target temperature is reached.

The temperature of recording paper 10 may be measured in the vicinity of the exit of pre-fixing unit 4 as described above. Alternatively, in a case where the pre-fixing unit is in the form of a roller in contact with paper, the roller surface temperature may be measured immediately after the recording paper is separated from the roller. In this case, the temperature may be measured by a noncontact-type sensor or may be measured by a contact-type sensor. Since the thermal capacity of the material (for example, rubber) of the roller surface is greater than that of paper, the contact-type sensor can measure the temperature with less effect on the temperature of the measured object.

Control device 8 estimates the amount of carrier liquid in the toner layer based on information from infiltration amount measuring unit 1. The proportion of the mass of toner to the entire liquid developer (TC ratio) is known in advance. Therefore, if the amount of carrier liquid infiltrated in recording paper is known, the amount of carrier liquid in the toner layer can be estimated.

Then, pre-fixing unit 4 is controlled such that the amount of carrier liquid in the toner layer falls within the appropriate range, based on the estimation result of the amount of carrier liquid. Specifically, the heating conditions are determined such that the temperature of recording paper 10 after pre-fixing reaches a target temperature in order to adjust the amount, of carrier liquid in the toner layer within the appropriate range by volatilizing the carrier liquid. In this embodiment, a voltage command value for driving the heater is applied from control device 8 to a heater power supply 14 driving a heater 12 arranged in pre-fixing unit 4, by way of example (see FIG. 3).

To determine the heating conditions, it is also necessary to grasp the temperature of recording paper before heating at pre-fixing unit 4. For this purpose, apparatus temperature measuring unit 3 is provided to grasp the temperature of recording paper 10 before it enters pre-fixing unit 4.

Apparatus temperature measuring unit 3 to measure temperature inside the apparatus, includes a temperature sensor and a temperature sensor amplifier. Specifically, the temperature sensor is provided in the proximity of a paper conveyance unit upstream of pre-fixing unit 4 in the apparatus in order to grasp the temperature of paper before passing through pre-fixing unit 4. A general thermistor or the like can be used as the temperature sensor. The output of the temperature sensor is linearized and amplified by the dedicated temperature sensor amplifier to be input as a temperature signal to control device 8 for use in determining the heating conditions.

Drier 9 is provided downstream of main fixing unit 5 to dry the carrier liquid infiltrated into recording paper 10 after main fixing. Control device 8 sets a voltage to be supplied to the heat source (infrared heater, not shown) of drier 9 based on the amount of carrier liquid infiltrated in the recording paper.

Figure 3:
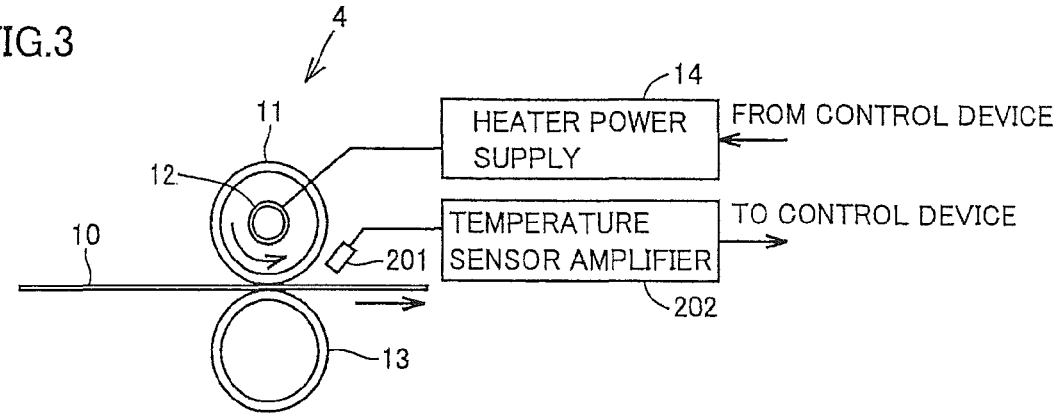
FIG. 3 illustrates a configuration of a pre-fixing unit 4 in accordance with the embodiment of the present invention.

FIG. 3 illustrates a configuration of pre-fixing unit 4 in accordance with the embodiment of the present invention.

Referring to FIG. 3, pre-fixing unit 4 in the form of a roller is shown here.

Specifically, heater 12 is provided in the inside of a heating roller 11 in contact with recording paper 10 on the side that toner is adhered on. A pressure roller 13 is brought into pressure contact from the back side of recording paper 10 to efficiently transmit heat. Heater power supply 14 is connected to heater 12. Heater power supply 14 is connected to control device 8 so that a voltage to be supplied to heater 12 is controlled in accordance with a voltage command value from control device 8. In this embodiment, a voltage command value is applied from control device 8 to heater power supply 14. However, the present invention is not limited thereto, and an electric power value, a current value, or a switch signal for changing the heating conditions (state) of heater 12 may be applied.

Paper temperature measuring unit 2 is configured with a paper temperature sensor 201 and a temperature sensor amplifier 202 and is installed so as to measure the paper temperature in the vicinity of a roller nip exit between heating roller 11 and pressure roller 13. The output of paper temperature sensor 201 is linearized and amplified by temperature sensor amplifier 202 to be input as a temperature signal to control device 8.

Pre-fixing unit 4 is to adjust the amount of carrier liquid as appropriate by volatilizing or removing the amount of carrier liquid in the toner layer before recording paper 10 enters main fixing unit 5. As long as this object is achieved, pre-fixing unit 4 may not be in the form of a roller in contact with recording paper for heating but may be in any other form. For example, recording paper may be heated in a contactless manner.

Figure 4:
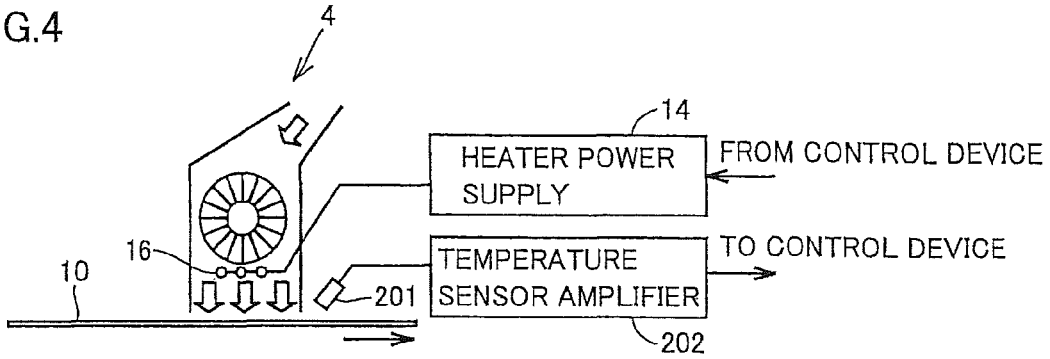
FIG. 4 illustrates a configuration of another pre-fixing unit 4 in accordance with the embodiment of the present invention.

FIG. 4 illustrates a configuration of another pre-fixing unit 4 in accordance with the embodiment of the present invention.

Referring to FIG. 4, here, a pre-fixing unit in the form of blowing hot air is shown.

Specifically, a heater 16 is provided as a heat source of hot air. Heater power supply 14 is connected to heater 16. Heater power supply 14 is connected to control device 8 so that a voltage supplied from heater power supply 14 to heater 16 is controlled in accordance with a voltage command value from control device 8.

Paper temperature measuring unit 2 is configured with paper temperature sensor 201 and temperature sensor amplifier 202. Paper temperature sensor 201 is provided such that paper passes through an effective section in which hot air is blown and that the paper temperature can be measured in the vicinity of the exit of the effective section.

Figure 5:
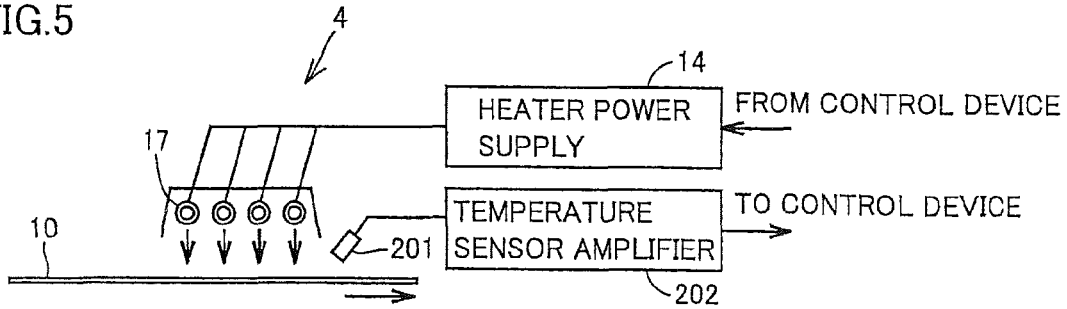
FIG. 5 illustrates a configuration of yet another pre-fixing unit 4 in accordance with the embodiment of the present invention.

FIG. 5 illustrates a configuration of yet another pre-fixing unit 4 in accordance with the embodiment of the present invention.

Referring to FIG. 5, here, pre-fixing unit 4 using radiant heat is shown.

Specifically, an infrared heater 17 is provided as a heat source. Heater power supply 14 is connected to infrared heater 17. Heater power supply 14 is connected to control device 8 so that a voltage supplied from heater power supply 14 to infrared heater 17 is controlled in accordance with a voltage command value from control device 8.

Paper temperature measuring unit 2 is configured with paper temperature sensor 201 and temperature sensor amplifier 202. Paper temperature sensor 201 is provided such that paper passes through an effective section irradiated with infrared rays and that the paper temperature is measured in the vicinity of the exit of the effective section.

Figure 6:
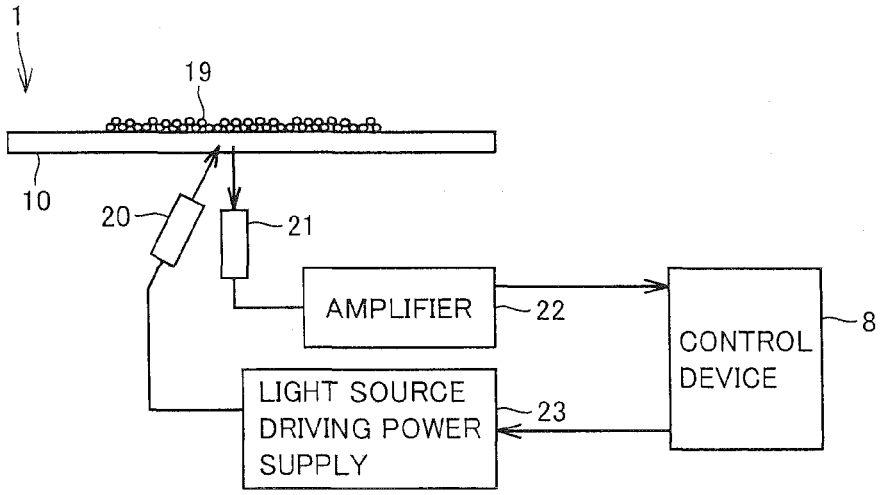
FIG. 6 illustrates a configuration of an infiltration amount measuring unit 1 in accordance with the embodiment of the present invention.

FIG. 6 illustrates a configuration of infiltration amount measuring unit 1 in accordance with the embodiment of the present invention.

Referring to FIG. 6, infiltration amount measuring unit 1 includes a light source 20, a light-receiving element 21, an amplifier 22, and a light source driving power supply 23.

Infiltration amount measuring unit 1 in accordance with the embodiment of the present invention measures the amount of infiltration of carrier liquid 19 into recording paper 10 based on that the opacity of recording paper 10 changes when the carrier liquid 19 is infiltrated into recording paper 10.

In this embodiment, light source 20 and light-receiving element 21 for sensing reflected light are arranged on the back side of recording paper 10.

When the amount of infiltration of carrier liquid into recording paper 10 is large, light emitted from light source 20 is transmitted through recording paper 10. Therefore, the amount of reflected light received by light-receiving element 21 is reduced as compared with when no carrier liquid is infiltrated into recording paper 10. In this embodiment, the reflected light is converted into a voltage signal, and a difference ΔE (V) is used as a signal indicative of the amount of infiltration, where the reflected light from recording paper 10 having no carrier liquid infiltrated is used as a reference.

The relation between the difference ΔE and the amount of infiltration is grasped beforehand by experiments and is tabulated in a table, which is stored into a not-shown storage unit of control device 8.

Figure 7:
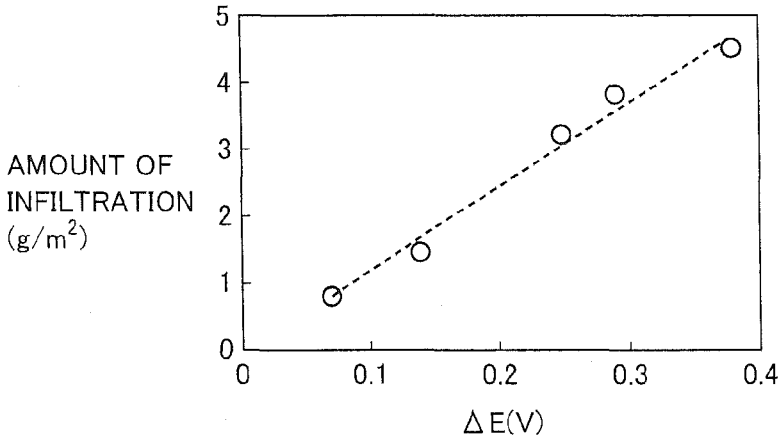
FIG. 7 illustrates the relation between the amount of infiltration of carrier liquid in recording paper and a difference $\Delta E$ between reflected light obtained when the carrier liquid is not infiltrated and reflected light obtained when it is infiltrated.

FIG. 7 illustrates the relation between the amount of infiltration of carrier liquid in recording paper and the difference ΔE in accordance with the embodiment of the present invention.

As shown in FIG. 7, the amount of infiltration of carrier liquid into recording paper can be measured by detecting the difference ΔE.

In this embodiment, the relation between the amount of infiltration of carrier liquid and the difference ΔE is shown in a case where the type of the recording paper is standard and the thickness thereof is medium.

It is noted that the relation between the amount of infiltration of carrier liquid and the difference ΔE is also affected by the amount of toner transferred to recording paper (the amount of adhered toner). Therefore, a test patch (also referred to as a test pattern, which is so-called solid image) was created with the amount of adhered toner kept constant, and the relation between the amount of infiltration of carrier liquid and the difference ΔE was measured based on recording paper having a test patch. A process using the recording paper having a test patch similarly will be described below. Specifically, in the test patch, the amount of adhered toner is set to 3 $g/m^2$. A solid image of 10 cm in the conveyance direction and 5 cm in the direction vertical to the conveyance direction was created. In this example, OK Top Coat of 127.9 $g/m^2$ (Oji Paper Co., Ltd.) was used as standard paper. The test patch may be created at an appropriate timing according to a timing at which the relation between the amount of infiltration of carrier liquid and the difference ΔE is expected to change, for example, when the image forming apparatus is powered on or when the use environment of the image forming apparatus, such as temperature, moisture, and altitude, varies greatly.

Shown here is the case where the relation between the amount of infiltration of carrier liquid and the difference ΔE is linear. An approximate linear function is stored beforehand in a storage unit based on the measurement result using the test patch created as described above, by way of example.

The relation between the amount of infiltration of carrier liquid and the difference ΔE is also affected by the type and thickness of recording paper. Therefore, a table for each paper type may be provided. Specifically, the approximate linear function based on the measurement result using a test patch for each paper type may be stored beforehand in a storage unit. Alternatively, a coefficient table may be provided in which the slope of the linear function shown in FIG. 7 varies for each paper type, and the linear function depending on the paper type may be calculated according to the linear function stored in the storage unit as shown in FIG. 7 and the coefficient according to the coefficient table.

Figure 8:
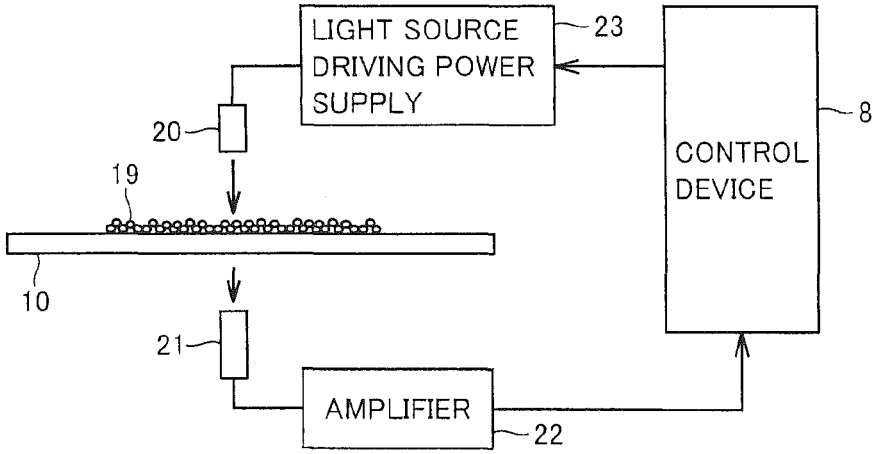
FIG. 8 illustrates a configuration of another infiltration amount measuring unit 1 in accordance with the embodiment of the present invention.

FIG. 8 illustrates a configuration of another infiltration amount measuring unit 1 in accordance with the embodiment of the present invention.

Referring to FIG. 8, infiltration amount measuring unit 1 includes light source 20, light-receiving element 21, amplifier 22, and light source driving power supply 23.

Infiltration amount measuring unit 1 in accordance with the embodiment of the present invention measures the amount of infiltration of carrier liquid 19 into recording paper 10 based on that the opacity changes when the carrier liquid 19 is infiltrated into recording paper 10.

In this embodiment, light source 20 is arranged on the front side of recording paper 10, and light-receiving element 21 for sensing reflected light is arranged on the back side thereof.

When the amount of infiltration of carrier liquid into recording paper 10 is large, light emitted from light source 20 is transmitted through recording paper 10. Therefore, the amount of transmitted light received by light-receiving element 21 is increased. Then, the transmitted light is converted into a voltage signal, and a difference ΔE (V) is used as a signal indicating the amount of infiltration, where the transmitted light through recording paper 10 having no carrier liquid infiltrated is used as a reference. In this measurement method, light having a wavelength that passes through the pigment in the toner layer on recording paper 10 is adopted as light from light source 20, so that the light reaches recording paper 10 without being absorbed in the pigment in the toner layer. Therefore, the amount of carrier liquid infiltrated into recording paper 10 can be measured by measuring the amount of transmitted light received by light-receiving element 21.

In other methods of measuring the amount of infiltration of carrier liquid, the amount of infiltration may be analyzed by capturing the amount of attenuation of ultrasound being applied, or the amount of infiltration may be measured by using the spectral absorption characteristics of the carrier liquid.

Figure 9:
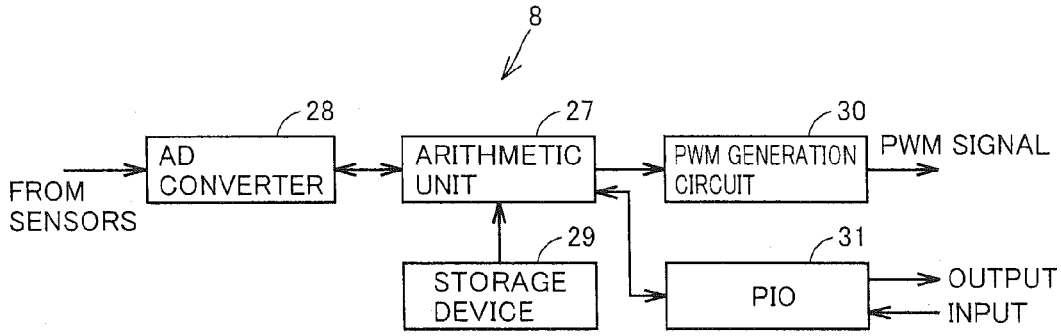
FIG. 9 illustrates a configuration of a control device 8 in accordance with the embodiment of the present invention.

FIG. 9 illustrates a configuration of control device 8 in accordance with the embodiment of the present invention.

Referring to FIG. 9, control device 8 in accordance with the embodiment of the present invention includes an arithmetic unit 27, an AD converter 28, a storage device 29, a PWM generation circuit 30, and a PIO 31 performing input/output of a digital signal.

Arithmetic unit 27 is connected to PIO 31 to receive input of information about the paper type according to user's operation from operation unit 50 shown in FIG. 1. The information about the paper type includes information of the type of recording paper, the thickness of recording paper, and the like.

AD converter 28 is connected to infiltration amount sensor amplifier 22 of infiltration amount measuring unit 1, temperature sensor amplifier 202 of paper temperature measuring unit 2 disposed downstream of pre-fixing unit 4, and the temperature sensor amplifier of apparatus temperature measuring unit 3 disposed upstream of pre-fixing unit 4, to convert the signals therefrom into digital signals, which are sent to arithmetic unit 27.

The amount of infiltration of carrier liquid into recording paper 10 is obtained as follows. Arithmetic unit 27 obtains the digital signal from the infiltration amount sensor amplifier to find the difference ΔE and find the amount of infiltration based on the linear function shown in FIG. 7 that is stored in storage device 29. The amount of infiltration depending on the paper type may be obtained referring to the coefficient table for each paper type. Then, the amount of carrier liquid left in the toner layer is estimated from the amount of infiltration.

The optimum setting of the paper temperature in pre-fixing unit 4 is determined using a paper temperature table which is created beforehand based on the amount of carrier liquid left in the toner layer and is stored in storage device 29.

Figure 10:
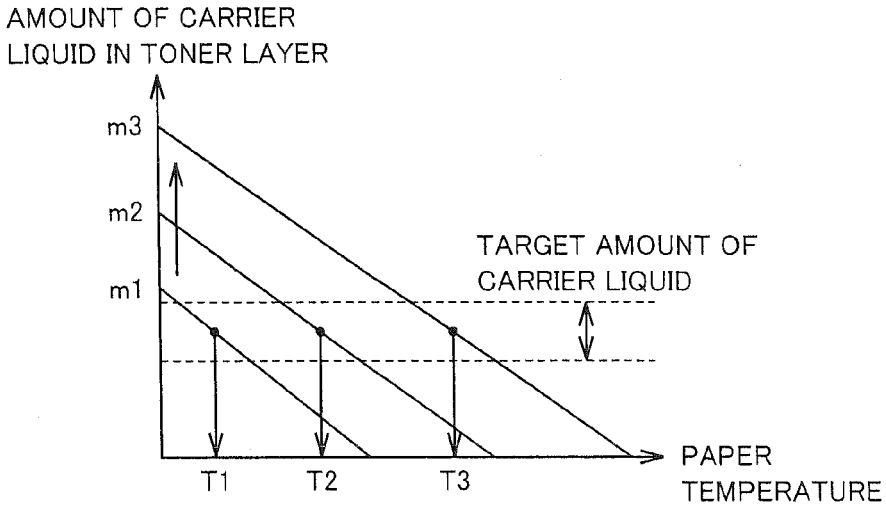
FIG. 10 illustrates the relation between the temperature of paper and the amount of carrier liquid in a toner layer in accordance with the embodiment of the present invention.

FIG. 10 illustrates the relation between the temperature of paper and the amount of carrier liquid in the toner layer in accordance with the embodiment of the present invention.

As shown in FIG. 10, the paper temperature to achieve the target amount of carrier liquid after passing through pre-fixing unit 4 varies according to the amount of carrier liquid in the toner layer before passing through pre-fixing unit 4. For example, the target amount of carrier liquid is set to fall within a prescribed range, and the amount of carrier liquid is volatilized or removed to reach the intermediate value in the range. In order to achieve the same amount of carrier liquid, a higher paper temperature is required as the amount of carrier liquid in the toner layer before pre-fixing is larger ($m1<m2<m3$, $T1<T2<T3$). Here, in this embodiment, the relation between the amount of carrier liquid in the toner layer and the paper temperature is shown in the case where the type of recording paper is standard and the thickness is medium.

The relation between the amount of carrier liquid in the toner layer and the paper temperature is obtained by creating a test patch (solid image), scraping off the solid image with a knife edge or the like, and measuring a change in weight between before and after drying when the paper temperature is changed.

The linear function approximated based on the measurement result is stored beforehand in storage device 29, so that the optimum paper temperature can be determined to achieve the target amount of carrier liquid from the estimated amount of carrier liquid in the toner layer.

Considering the effect of the type and thickness of recording paper, a table for each paper type may be provided. Specifically, the linear function approximated based on the measurement result for each paper type may be stored beforehand in a storage unit. Alternatively, a coefficient table may be provided in which the slope of the linear function shown in FIG. 10 varies for each paper type, and the linear function depending on the paper type may be calculated according to the linear function stored in the storage unit as shown in FIG. 10 and the coefficient according to the coefficient table.

After determining the paper temperature, arithmetic unit 27 calculates a voltage command value to be output to heater power supply 14. Specifically, arithmetic unit 27 outputs the voltage command value to PWM generation circuit 30 based on the information about the paper type, the paper temperature before passing through pre-fixing unit 4, and the determined paper temperature. PWM generation circuit 30 outputs a PWM signal according to the voltage command value. Heater power supply 14 is PWM-controlled in response to the PWM signal.

Figure 11:
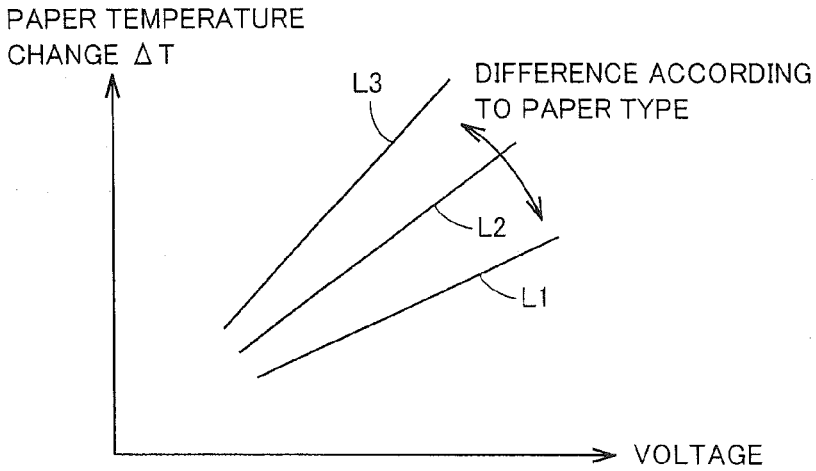
FIG. 11 illustrates the relation between a paper temperature change ΔT and a voltage command value in accordance with the embodiment of the present invention.

FIG. 11 illustrates the relation between a paper temperature change ΔT and a voltage command value in accordance with the embodiment of the present invention.

Referring to FIG. 11, shown here is the relation between a paper temperature change ΔT (ΔT is obtained by subtracting "the paper temperature before passing through pre-fixing unit 4" from "the determined paper temperature") represented by the axis of ordinates and a voltage command value represented by the axis of abscissas. The relation for each paper type is also shown. L1 represents thick paper, L3 represents thin paper, and L2 represents intermediate paper. The relation between the paper temperature change ΔT and the voltage command value is obtained by creating a test patch (solid image) and measuring a change in paper temperature by changing voltage values, according to the paper type.

The paper temperature change ΔT can be calculated based on the paper temperature determined by arithmetic unit 27 and the paper temperature measured by apparatus temperature measuring unit 3. Specifically, the paper temperature change ΔT can be calculated by subtracting the paper temperature measured by apparatus temperature measuring unit 3, which is the paper temperature before passing through pre-fixing unit 4, from the paper temperature determined by arithmetic unit 27.

Then, considering that the thermal capacity varies according to the paper type, the linear function approximated based on the measurement result according to the paper type is stored beforehand in storage device 29, and the voltage command value is set according to the paper temperature change ΔT. As shown in FIG. 11, thicker paper requires a higher voltage command value to bring about the same paper temperature change.

A PWM signal is output from PWM (Pulse Width Modulation) generation circuit 30 according to the set voltage command value to drive heater power supply 14.

In a case of successive printing, feedback control may be executed such that the paper temperature of recording paper 10 after passing through pre-fixing unit 4 is always monitored and sent to arithmetic unit 27 through AD converter 28 so that the target paper temperature is achieved.

In this embodiment, the required voltage command value is calculated by calculating the paper temperature change ΔT. Alternatively, feedback control may be performed such that the paper temperature determined in FIG. 10 is achieved without calculating the paper temperature change ΔT. However, in view of energy efficiency, it is desirable to calculate the paper temperature change ΔT to apply the voltage command value and thereafter perform feedback control for fine adjustment.

Figure 12:
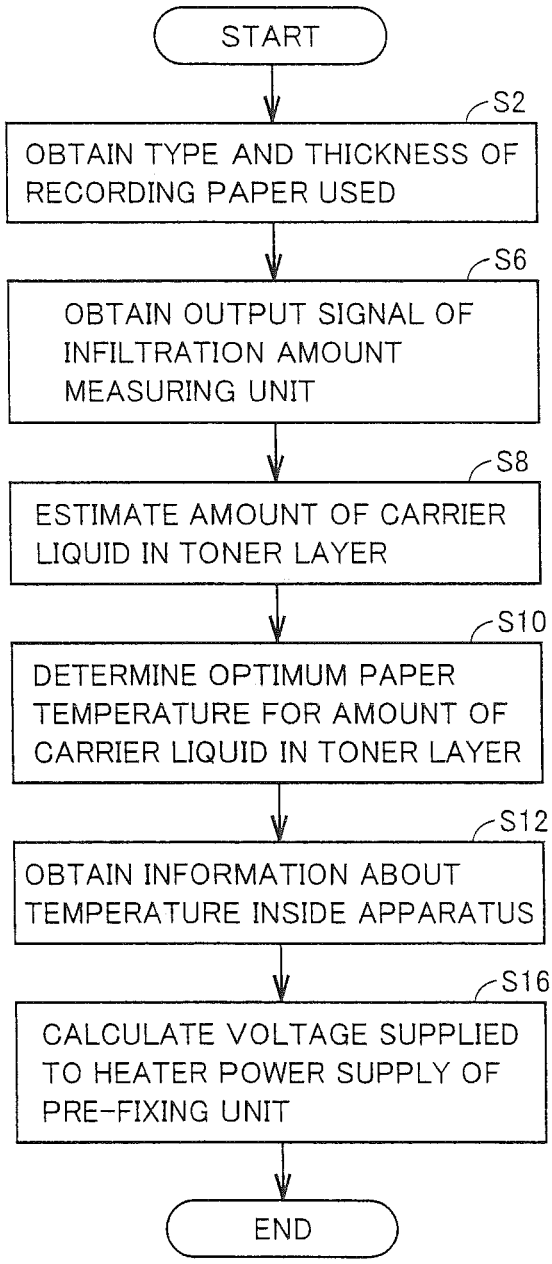
FIG. 12 is a flowchart illustrating a method of calculating electric power of a heater power supply of pre-fixing unit 4 in accordance with the embodiment of the present invention.

FIG. 12 is a flowchart illustrating a method of calculating electric power of the heater power supply of pre-fixing unit 4 in accordance with the embodiment of the present invention. The flow is executed in control device 8.

Referring to FIG. 12, first, the type and thickness of recording paper used is obtained as information about paper type (step S2). Specifically, the information about the type of recording paper and the thickness of recording paper according to user's operation is obtained from operation unit 50. For example, the user selects a number corresponding to the manufacturer and model number of the recording paper, and the information about the selected recording paper is in turn input to arithmetic unit 27 via PIO 31.

Then, the output signal of infiltration amount measuring unit 1 is obtained (step S6). Specifically, a signal indicative of the amount of infiltration of carrier liquid in the recording paper is obtained from infiltration amount measuring unit 1. The amount of carrier liquid infiltrated in recording paper 10 can be measured from this signal based on the linear function shown in FIG. 7. In this embodiment, a test patch (solid image) is created on recording paper 10 with the amount of adhered toner being kept constant according to an instruction from main control unit 52, and a signal indicative of the amount of infiltration of carrier liquid in recording paper is obtained from the recording paper having the test patch.

Then, the amount of carrier liquid in the toner layer is estimated (step S8).

Here, the amount of carrier liquid adhered as the toner layer can be calculated based on the proportion of the mass of toner particles to the entire liquid developer (TC ratio), which is set at a prescribed value in developing device 44.

Therefore, it becomes possible to estimate the amount of carrier liquid left in the toner layer by subtracting the amount of infiltration in recording paper 10, which is obtained as an output signal of infiltration amount measuring unit 1, from the amount of carrier liquid adhered as the toner layer.

Then, the optimum paper temperature is determined to achieve the target amount of carrier liquid in the toner layer (step S10).

Specifically, the optimum paper temperature is determined based on the relation between the carrier liquid in the toner layer and the paper temperature shown in FIG. 10. For example, in a case where the target amount of carrier liquid falls within a prescribed range, the paper temperature may be determined such that the intermediate value is achieved.

Then, information about temperature inside the apparatus is obtained (step S12). The temperature, which is the paper temperature before passing through pre-fixing unit 4, is measured by apparatus temperature measuring unit 3.

Then, the voltage supplied to heater power supply 14 of pre-fixing unit 4 is calculated (step S16). Specifically, the voltage command value is determined based on the paper temperature change, which is the difference between the optimum paper temperature and the temperature inside the apparatus measured by apparatus temperature measuring unit 3 and based on the relation between the paper temperature change and the voltage value shown in FIG. 11.

The process then ends (END).

Through this process, in pre-fixing unit 4, the recording paper can be set at the optimum paper temperature for the carrier liquid in the toner layer on the recording paper, and the carrier liquid can be adjusted to the target amount.

Accordingly, the amount of carrier liquid in the toner layer can be adjusted within the appropriate range, thereby achieving both prevention of offset and good fixing performance.

In the flow in FIG. 12, the amount of carrier liquid in the toner layer is estimated from the output signal of infiltration amount measuring unit 1. This is because when measurement is carried out using a test patch, it is necessary to estimate the amount of carrier liquid in the actual toner layer in the test patch. However, once the linear functions shown in FIG. 7, FIG. 10, and FIG. 11 are created based on the measurement result of the test patch, the voltage command value can be determined directly from the output signal of infiltration amount measuring unit 1 in the subsequent image forming. Therefore, step S8 of estimating the amount of carrier liquid in the toner layer can be omitted. In the foregoing embodiment, the linear functions shown in FIG. 7, FIG. 10, and FIG. 11 are created. Instead, the respective tables may be created. Furthermore, a table for finding the paper temperature directly from the amount of infiltration of carrier liquid may be created.

Figure 13:
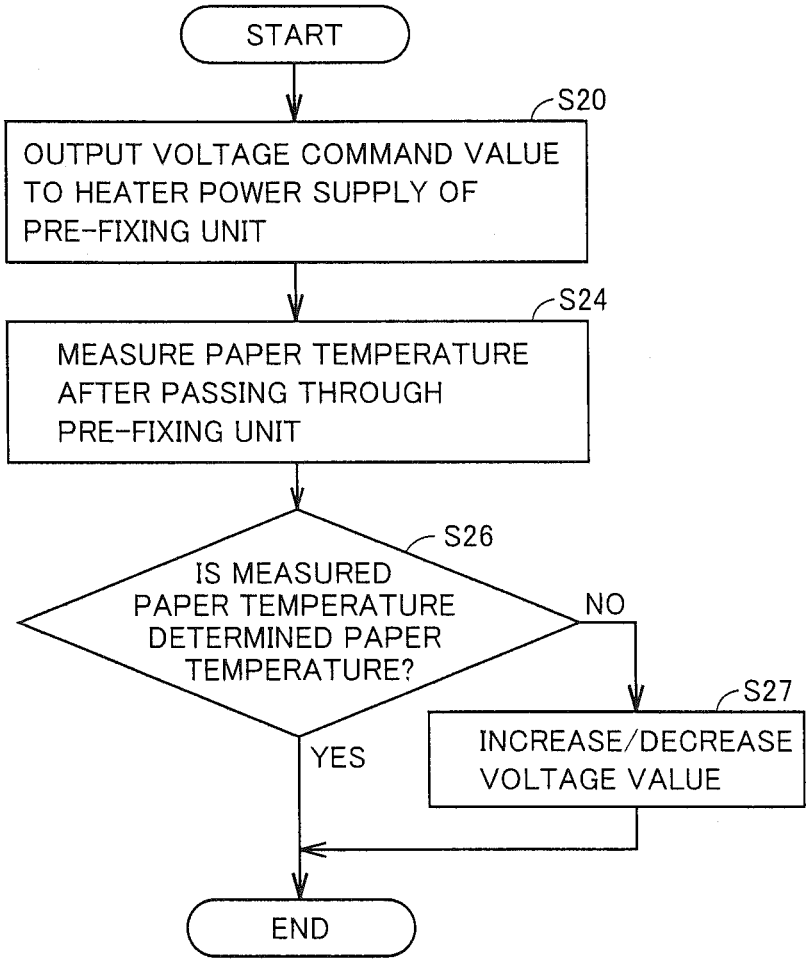
FIG. 13 is a flowchart of feedback control of the heater power supply of pre-fixing unit 4 in accordance with the embodiment of the present invention.

FIG. 13 is a flowchart of feedback control of heater power supply 14 of pre-fixing unit 4 in accordance with the embodiment of the present invention.

Referring to FIG. 13, a voltage command value is output to the heater power supply of pre-fixing unit 4 (step S20). Specifically, the voltage command value determined to achieve the appropriate set temperature is output. Heater power supply 14 thus drives heater 12 according to the voltage command value such that recording paper 10 is heated to the determined set temperature.

Then, the paper temperature of recording paper 10 after passing through pre-fixing unit 4 is measured (step S24). Then, it is determined whether the measured paper temperature of recording paper 10 is the determined set temperature (step S26). The determination as to whether the measured paper temperature of recording paper 10 is the determined set temperature is not necessarily based on whether the temperatures are equal, but a prescribed margin may be allowed and whether the temperature difference falls within a prescribed range may be determined.

If it is determined in step S26 that the measured paper temperature of recording paper 10 is the determined paper temperature (YES in step S26), the process ends (END).

On the other hand, if it is determined in step S26 that the measured paper temperature of recording paper 10 is not the determined paper temperature (NO in step S26), the voltage value is increased/decreased (step S27). Specifically, if it is determined that the measured paper temperature of recording paper 10 is lower than the determined paper temperature, the voltage command value is increased by a prescribed value. On the other hand, if it is determined that the measured paper temperature of recording paper 10 is higher than the determined paper temperature, the voltage command value is decreased by a prescribed value. The level of the value increased/decreased may be changed according to the temperature difference.

The process then ends (END).

Through this process, the result of the measured paper temperature of the recording paper is reflected in fine adjustment of the voltage command value supplied to heater power supply 14, so that the paper temperature of recording paper 10 is stably set to the optimum paper temperature, and the amount of carrier liquid in the toner layer is adjusted within the appropriate range.

In the configuration described above, the carrier liquid in the recording paper is adjusted to the appropriate amount by setting a voltage supplied to heater power supply 14 of pre-fixing unit 4 for recording paper 10, based on the result of measurement of the carrier liquid infiltrated in recording paper 10 by infiltration amount measuring unit 1. The measurement result by infiltration amount measuring unit 1 can be used to set a voltage to be supplied to the heater power supply of drier 9 in order to adjust the carrier liquid infiltrated in recording paper 10 to the appropriate amount as follows.

Figure 14:
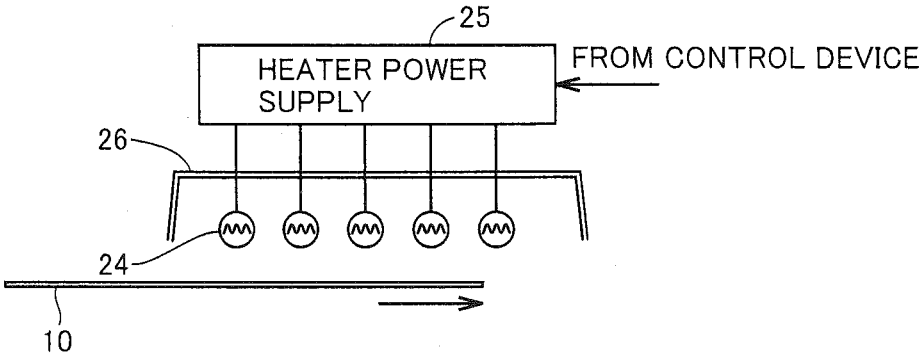
FIG. 14 illustrates a configuration of a drier 9 in accordance with the embodiment of the present invention.

FIG. 14 illustrates a configuration of drier 9 in accordance with the embodiment of the present invention.

Referring to FIG. 14, drier 9 includes a heater power supply 25, infrared heaters 24, and a heat-insulating cover 26.

A plurality of infrared heaters 24 are installed in the direction in which recording paper 10 is conveyed, and heat-insulating cover 26 is provided to cover these heaters. Control device 8 can change the conditions of drying by controlling heater power supply 25 to change a voltage supplied to infrared heaters 24 or to change the number of infrared heaters being driven. The heating method is not limited to infrared heaters, and hot air may be used. A contactless type is desirable to promote drying of the carrier liquid infiltrated in recording paper 10.

In this embodiment, the voltage supplied to infrared heaters 24 or the number of infrared heaters being driven is determined by the information obtained from infiltration amount measuring unit 1 and the paper type information. The information about paper type is obtained, for example, from the information about the type of recording paper and the thickness of recording paper 10 according to user's operation from operation unit 50.

Figure 15:
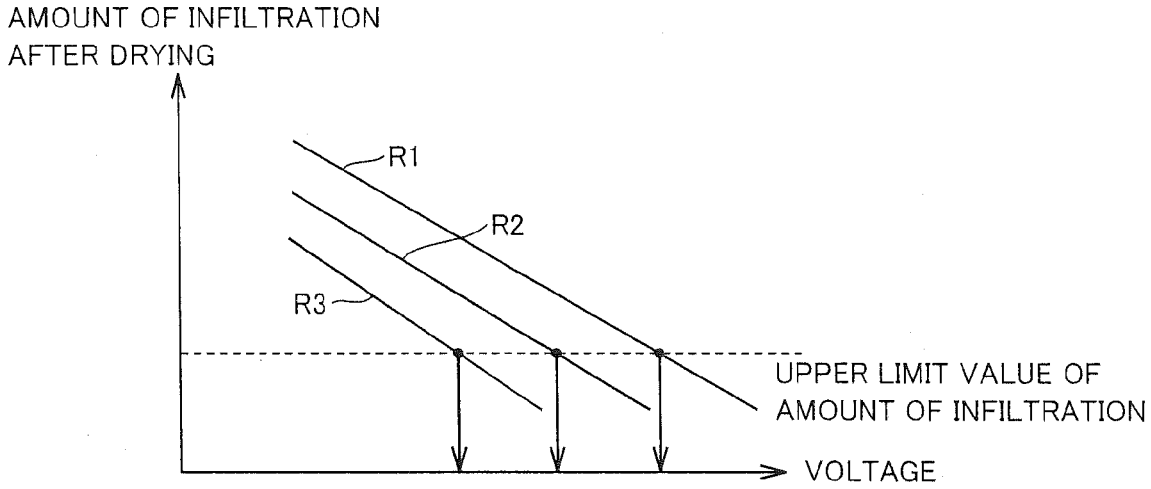
FIG. 15 illustrates the relation between the amount of infiltration after drying and voltage supplied to heater power supply 25 in accordance with the embodiment of the present invention.

FIG. 15 illustrates the relation between the amount of infiltration of carrier liquid into recording paper 10 after drying and the voltage supplied to heater power supply 25 in accordance with the embodiment of the present invention.

As shown in FIG. 15, the voltage value set to bring the amount of infiltration after drying to a prescribed upper limit value or lower varies according to the amount of carrier liquid infiltrated in recording paper 10. Here, in this embodiment, the relation between the amount of infiltration of carrier liquid after drying and the voltage is shown in a case where the type of recording paper 10 is standard and the thickness is medium. The amount of carrier liquid infiltrated in recording paper 10 is largest in R1 and smallest in R3, and R2 is intermediate therebetween. The voltage required to reduce the amount of infiltration to the upper limit value by drying is also highest in R1 and lowest in R3, and R2 is intermediate therebetween. This relation is obtained by creating a test patch (solid image) on recording paper 10 with the amount of adhered toner being kept constant according to an instruction from main control unit 52 and measuring a change in weight of recording paper 10 having the test patch between before and after drying when the voltage is changed.

The linear function approximated based on the measurement result is stored beforehand in storage device 29 so that the optimum voltage can be set to achieve the appropriate amount of carrier liquid infiltrated in recording paper 10 after drying.

Considering the effects of the type and thickness of recording paper 10, a table for each paper type may be provided. Specifically, the linear function approximated based on the measurement result for each paper type may be stored beforehand in the storage device. Alternatively, a coefficient table may be provided in which the slope of the linear function shown in FIG. 15 varies for each paper type, and the linear function depending on the paper type may be calculated according to the linear function stored in the storage unit as shown in FIG. 15 and the coefficient according to the coefficient table.

Figure 16:
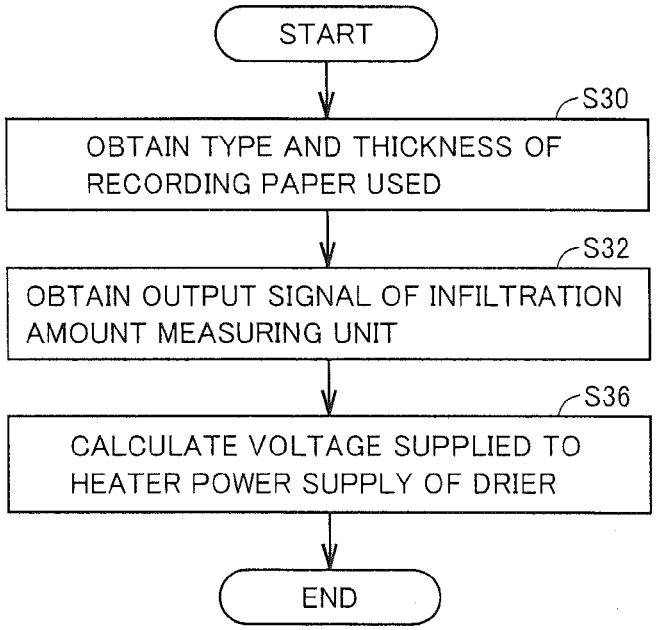
FIG. 16 is a flowchart illustrating a method of calculating electric power of the heater power supply of drier 9 in accordance with the embodiment of the present invention.

FIG. 16 is a flowchart illustrating a method of calculating electric power of the heater power supply of drier 9 in accordance with the embodiment of the present invention. This flow is executed in control device 8.

Referring to FIG. 16, first, the type and thickness of recording paper used, which is the information about paper type, is obtained (step S30). For example, the information about the type of recording paper and the thickness of recording paper according to user's operation is obtained from operation unit 50.

Then, the output signal of infiltration amount measuring unit 1 is obtained (step S32). Specifically, a signal indicative of the amount of infiltration of carrier liquid in recording paper 10 that is input from infiltration amount measuring unit 1 is obtained. In this embodiment, a test patch (solid image) is created on recording paper 10 with the amount of adhered toner being kept constant according to an instruction from main control unit 52, and a signal indicative of the amount of infiltration of carrier liquid in the recording paper having the test patch is obtained. The amount of carrier liquid infiltrated in recording paper 10 can be measured from this signal based on the linear function shown in FIG. 7 that is stored in storage device 29.

Then, a voltage to be supplied to the heater power supply of drier 9 is calculated (step S36). Specifically, the voltage value is determined such that the amount of infiltration after drying falls below the upper limit value of the amount of infiltration, based on the relation between the amount of infiltration of carrier liquid into recording paper 10 after drying and the voltage value shown in FIG. 15. As can be understood from FIG. 15, the higher is the voltage, the smaller is the amount of infiltration after drying.

The process then ends (END).

Through this process, the voltage command value is output from control device 8 to heater power supply 25, and heater power supply 25 thus drives infrared heaters 24, so that the carrier liquid infiltrated in recording paper 10 is dried until it is reduced to the appropriate amount. Accordingly, strike-through or similar problems resulting from the large amount of carrier liquid left in recording paper 10 can be avoided.

In the flowchart in FIG. 16, the processing in step S30 and step S32 are provided. However, when heater power supply 14 in pre-fixing unit 4 is controlled, the type and thickness of recording paper used and the output signal of infiltration amount measuring unit 1 are obtained in steps S2 and S6 in the flowchart in FIG. 12. Therefore, the processing in steps S30 and S32 may be omitted, and the voltage to be supplied to the heater power supply of drier 9 may be calculated based on the information above.

In the flowchart in FIG. 16, the amount of carrier liquid infiltrated in recording paper 10 after drying is adjusted based on the measurement result by infiltration amount measuring unit 1. On the other hand, after being measured by infiltration amount measuring unit 1, the recording paper is heated in pre-fixing unit 4 and in main fixing unit 5. In heating, the side of the toner layer on recording paper 10 is heated both in pre-fixing unit 4 and main fixing unit 5, so that the carrier liquid in the toner layer is mainly volatilized or removed. However, the carrier liquid infiltrated into recording paper 10 may also be partially volatilized or removed by heating. Therefore, a similar table as in the relation between the amount of carrier liquid in the toner layer and the voltage command value may also be stored in storage device 29 for the amount of carrier liquid in recording paper 10 and the voltage command value. Then, a change amount of carrier liquid infiltrated in recording paper 10 after passing through pre-fixing unit 4 and main fixing unit 5 may be measured using a test patch, and the heating conditions in drier 9 may be determined in consideration of this change amount.

In the embodiment above, drier 9 is configured to include infrared heaters 24. However, a method of drying using hot air may be employed.

Although the present invention has been described and illustrated in detail, it is clearly understood that the drawings and preferred embodiments are made by way of illustration and example only and are not to be taken by way of limitation, the scope of the present invention being interpreted by the terms of the appended claims.

What is claimed is:

1. A wet-type image forming apparatus which forms an image using a liquid developer containing carrier liquid and toner dispersed therein, comprising:

a fixing device structured to fix a toner image formed by development using the liquid developer onto an image recording medium;

a first measuring device structured to carry out measurement for obtaining information corresponding to an amount of the carrier liquid infiltrated into the image recording medium before the image recording medium passes through the fixing device; and an adjusting device structured to adjust an amount of the carrier liquid contained in the toner image on the image recording medium by heating based on a result of the measurement carried out by the first measuring device, the adjusting device comprising:

a first heating device structured to heat the image recording medium, and a controlling device structured to determine heating conditions of the first heating device based on the result of the measurement for obtaining the information corresponding to the amount of the carrier liquid infiltrated into the image recording medium before the image recording medium passes through the fixing device.

2. The wet-type image forming apparatus of claim 1, wherein the first heating device is structured to heat the image recording medium before the image recording medium passes through the fixing device.

3. The wet-type image forming apparatus of claim 2, further comprising a second heating device configured to heat the image recording medium after the image recording medium passes through the fixing device.

4. The wet-type image forming apparatus of claim 3, wherein the controlling device is configured to determine heating conditions of the second heating device based on the result of the measurement carried out by the first measuring device.

5. The wet-type image forming apparatus of claim 3, wherein the controlling device is configured to determine the heating conditions of the first heating device or the second heating device based on the result of the measurement by the first measuring device and a type of the image recording medium.

6. The wet-type image forming apparatus of claim 1, wherein the first heating device is configured to heat the image recording medium by hot air or by radiation without contacting the image recording medium.

7. The wet-type image forming apparatus of claim 1, further comprising: a second measuring device configured to measure a temperature of the image recording medium before the image recording medium passes through the adjusting device; and a third measuring device configured to measure a temperature of the image recording medium after the image recording medium passes through the adjusting device.

8. The wet-type image forming apparatus of claim 1, wherein the first measuring device is configured to carry out the measurement by emitting light on a side of the image recording medium opposite to a surface thereof on which the toner image is formed, and receiving light reflected by the image recording medium.

9. The wet-type image forming apparatus of claim 8, further comprising an imaging section configured to form a latent image and develop the latent image with the liquid developer to form the toner image, wherein the imaging section is configured to form a latent image of a test pattern and develop the latent image with the liquid developer, and the first measuring device is configured to carry out the measurement by emitting light on said side of the image recording medium opposite to the surface thereof on which the toner image of the test pattern is formed, and receiving light reflected by the image recording medium.

10. The wet-type image forming apparatus of claim 9, wherein the first measuring device is configured to carry out the measurement by emitting light toward an area of said side of the image recording medium, said area being opposite to an area on which the toner image of the test pattern is formed, and receiving light reflected by the area of said side of the image recording medium.

11. The wet-type image forming apparatus of claim 1, wherein the first measuring device is configured to carry out the measurement by emitting light on a surface of the image recording medium and receiving light passing through the image recording medium.

12. The wet-type image forming apparatus of claim 11, further comprising an imaging section configured to form a latent image and develop the latent image with the liquid developer to form the toner image, wherein the imaging section is configured to form a latent image of a test pattern and develop the latent image with the liquid developer, and the first measuring device is configured to carry out the measurement by emitting light on said surface of the image recording medium and receiving light passing through the image recording medium.

13. The wet-type image forming apparatus of claim 12, wherein the first measuring device is configured to carry out the measurement by emitting light toward an area of said surface of the image recording medium, on which area the toner image of the test pattern is formed, and receiving light passing through the toner image of the test pattern and the image recording medium.

* * * * *